United States Patent [19]

Murata

[11] 4,061,358

[45] Dec. 6, 1977

[54] SKI BOOT TOE BINDING

[75] Inventor: Masahiro Murata, Matsudo, Japan

[73] Assignee: Hope Co. Ltd., Tokyo, Japan

[21] Appl. No.: 714,016

[22] Filed: Aug. 13, 1976

[30] Foreign Application Priority Data

Oct. 31, 1975 Japan ..... 50-132017

[51] Int. Cl.[2] ..... A63C 9/08

[52] U.S. Cl. ..... 280/629

[58] Field of Search ..... 280/629, 630

[56] References Cited

U.S. PATENT DOCUMENTS

| | | | |
|---|---|---|---|
| 3,682,494 | 8/1972 | Frisch | 280/629 |
| 3,685,849 | 8/1972 | Marker | 280/629 |
| 3,692,322 | 9/1972 | Frisch | 280/629 |
| 3,761,105 | 9/1973 | Mimeur | 280/629 |

*Primary Examiner*—Robert R. Song

*Attorney, Agent, or Firm*—Emrich, Root, O'Keeffe & Lee

[57] ABSTRACT

In a ski boot toe binding of the type in which a boot toe holding member is swingably connected to a pivotable body by a pair of arms, a slidable cam plate is provided between a base plate and the pivotable body. The arms are held in an inoperative position independent of the cam plate, while the toe holding member is in a toe holding central position and is swung from the central position through a predetermined stroke, to allow the cam plate to take a locking position where the pivotable body is immovably engaged with the base plate. The cam plate is moved in the lengthwise direction of the base plate by an arm after the toe holding member is swung beyond the predetermined stroke whereby it is moved to an unlocked position where the engagement between the pivotable body and the base plate is released to allow the pivotable body to rotate relative to the base plate.

7 Claims, 7 Drawing Figures

SKI BOOT TOE BINDING

BACKGROUND OF THE INVENTION

This invention relates to a ski boot toe binding of the type in which a boot toe holding member is swingably connected to a pivotable housing or body by a pair of arms.

The toe binding of this type is known in U.S. Pat. No. 3,709,510 to have a long critical restitution stroke which allows the toe holding member to automatically return to the normal toe holding central position without releasing the boot therefrom when the force applied to the toe holding member is released.

One of the most important functions of a ski boot toe binding is to absorb an instantaneously applied shock which is not great enough to cause the skier's leg to break, and to hold the ski boot to the binding, but which will release the ski boot rapidly when a severe shock is applied to the skier's leg for a relatively long time period. To achieve the above functions satisfactorily, it is said that a boot toe binding having high shock absorbing energy is desirable.

The shock absorbing energy of the toe binding is determined by functions of restorable lateral displacements and lateral forces applied to the toe holding member to displace the latter laterally, which forces will not displace the binding to a boot toe releasing position. It is said that the binding having a longer critical restitution stroke and a higher critical binding force has higher shock absorbing energy.

Namely, if the critical binding force of the binding is made constant, the binding having a longer critical restitution stroke has a higher shock absorbing energy. On the other hand, if the critical binding force of the binding is made greater beyond a certain value, the binding will not be released as desired and will cause the skier's leg to break. Therefore, the critical binding force of the bindings cannot be greater than a certain value in practice, and it is desired to provide a binding having longer critical restitution stroke.

However, if the toe binding having high shock absorbing energy with an elongated critical restitution stroke does not have a strong power of restitution, the binding will not be able to attain the desired function, and will be dangerous in skiing because it takes a relatively long time period before the toe holding member, slightly displaced by an unobjectionable shock, returns to the original toe holding position.

Thus, it is desired that the toe binding has not only a longer critical restitution stroke, but also strong power of restitution.

In the known toe binding set forth above, although it has a relatively long critical restitution stroke, there remains some room for improvements with respect to the power of restitution.

That is, in the known toe binding set forth above, a locking means, such as a locking pin engagable with a journal and a cam secured about the locking pin, functions to set, not only the pivotable housing or body, but also the toe holding member, in toe holding central positions under a spring force. The toe holding member is swingably connected to a pivotable housing by a pair of arms, and the cam in the locking means acts against the rear ends of the arms to urge the toe holding member to the central position thereof. Accordingly, when a lateral force is applied to the toe holding member when in the central position thereof, the pivotable housing receives such a force that tends to rotate the housing about the journal, whereby the locking pin engaging the journal is pressed against the journal. In the event that the lateral force applied to the toe holding member is severe enough to displace the toe binding toward the toe releasing position, the toe holding member is swung as the rear end of one of the arms acts against the cam to retract the latter against the spring force and then the locking pin is disengaged from the journal, thereby rotating the pivotable housing about the journal to release the boot toe. However, while the locking pin is being disengaged from the journal, a high frictional resistance is produced therebetween by the force tending to rotate the pivotable housing about the journal.

Such a high frictional resistance is also produced when the toe holding member is displaced to a certain degree not reaching to the toe releasing position returns to the original toe holding central position by the decrease or elimination of the lateral shock applied to the boot toe.

Accordingly, in such a known toe binding set forth above, the power of restitution of the binding is greatly reduced due to high frictional resistance. On the other hand, if the spring force of the binding is made stronger to increase the power of restitution of the binding, due to the frictional resistance between the locking pin and the journal, the binding force of the binding will be much increased so that it will not release the toe as desired and, therefore, the spring force of the binding cannot be increased beyond a certain relatively low value.

Although the binding set forth above has a relatively high shock absorbing energy, the binding will not be satisfactory for practical use due to the low power of restitution.

SUMMARY OF THE INVENTION

Accordingly, a main object of the present invention is to provide an improved ski boot toe binding having high shock absorbing energy and high power of restitution.

Another object of the present invention is to provide a ski boot toe binding which can easily and automatically return a toe holding member, as well as a pivotable housing or body, to a normal toe holding central position from a toe releasing position.

It has been noted by the present inventor that in the event that the spring force for urging a toe holding member to the toe holding position also functions to urge a pivotable body to a normal toe holding position, in a toe binding of the type in which the toe holding member is swingably connected to the pivotable body by a pair of arms, a high frictional resistance is produced when the toe holding member swings toward a toe releasing position, with the result that the force of restitution of the toe holding member is greatly reduced.

Accordingly, in the present toe binding wherein a boot toe holding member is swingably connected to a pivotable body by a pair of arms, a yielding means, such as a compression spring, is used only for urging the toe holding member to a normal boot toe holding position but is not used for locking and unlocking the pivotal movement of the pivotable body. The locking and unlocking of the pivotal movement of the pivotable body is effected by a slidable cam plate provided between a base plate and the pivotable body. The cam plate is independent of the movement of each one of the arms in an inoperative position, while the toe holding member is in a toe holding central position, and is swung from the central position through a predetermined stroke, and takes a locking position where the pivot body is immovably engaged with the base plate. The cam plate is moved in the length-wise direction of the base plate by the arm after the toe holding member is swung beyond the predetermined stroke and is moved slightly to an unlocked position where the engagement between the pivotable body and the base plate is released to allow the pivotable body to rotate relative to the base plate.

Preferably, the cam plate has a longitudinal slot and a lateral slot communicating with each other to form a trifurcated slot. A projection mounted on the base plate is fitted into an end of the longitudinal slot adjacent to the lateral slot while the cam plate is separated from the arm in an inoperative position. Another projection on the pivotable body is slidably fitted into the other end portion of the longitudinal slot in the cam plate. The projection on the base plate enters into the lateral slot when the cam plate is slightly moved by the arm and allows the pivotable body to rotate relative to the base plate until the projection on the base plate abuts against the end of the lateral slot.

With such a structure of the present binding, when a severe lateral force is applied to the toe holding member, the toe holding member starts swinging laterally to be displaced against the yielding means. However, until the toe holding member is swung enough through a predetermined stroke where the arm comes into contact with the slidable cam plate, the cam plate is quite independent of, and has no relation with, the swinging movement of the toe holding member, and takes the locking position for setting the pivotable body into locking engagement with the base plate. The pivotable body is displaced to the boot toe releasing position when the cam plate is moved for a slight distance by the arm at the final stroke of the swinging movement of the toe holding member.

Accordingly, compared with the known binding of the type set forth above in which the locking pin for the pivotable body starts retracting against the spring force and the added high frictional resistance between the locking pin and the journal as the toe holding member starts swinging, the binding according to the present invention has no such frictional resistance until the arm comes to move the cam plate at the position where the toe holding member is sufficiently swung toward the toe releasing position and, therefore, the present binding has a high power of restitution.

In the toe binding according to the present invention, the frictional resistance produced after the final stroke of the toe holding member, where the arm contacts the cam plate and moves it in the lengthwise direction of the base plate, is very small since the movement of the cam plate to the unlocking position thereof is very short. Usually, binding force of the binding is set to become maximum at a slightly displaced position of the toe holding member and to be gradually reduced as the degree of displacement of the toe holding member is increased. Accordingly, although the binding force of the present binding is slightly increased by the frictional resistance at the final stroke of the toe holding member, the increased binding force cannot exceed the maximum critical binding force and, therefore, no problem arises in pratice.

With such a minimum or reduced frictional resistance, the present toe binding can have a high power or restitution in addition to the high shock absorbing energy.

The aforementioned and other objects and features of the present invention shall be described hereinafter in detail with reference to preferred embodiments thereof shown in the accompanying drawings, in which:

DETAILED DESCRIPTION OF THE INVENTION

Figure 1:
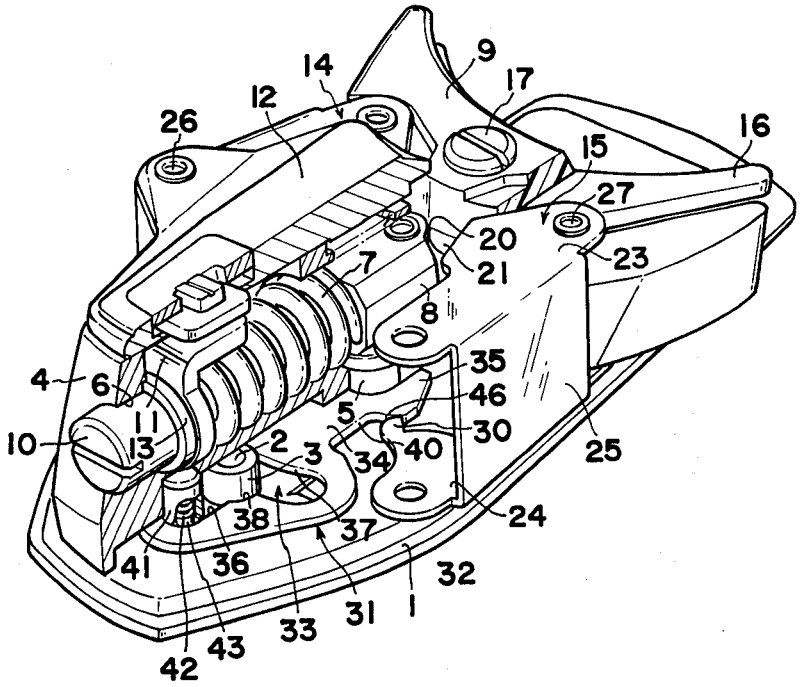
FIG. 1 is a perspective view with parts broken away and sectioned showing a boot toe binding according to the present invention, wherein a pivot body as well as a toe holding member are set to toe holding central positions.
Figure 2:
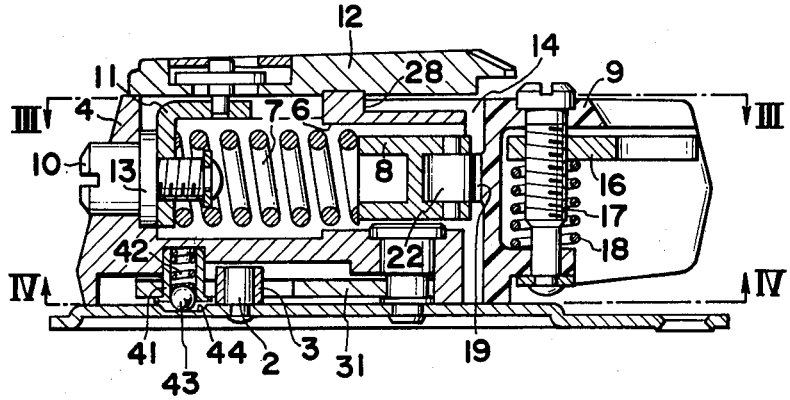
FIG. 2 is a vertical longitudinal section through the boot toe binding device of FIG. 1.
Figure 3:
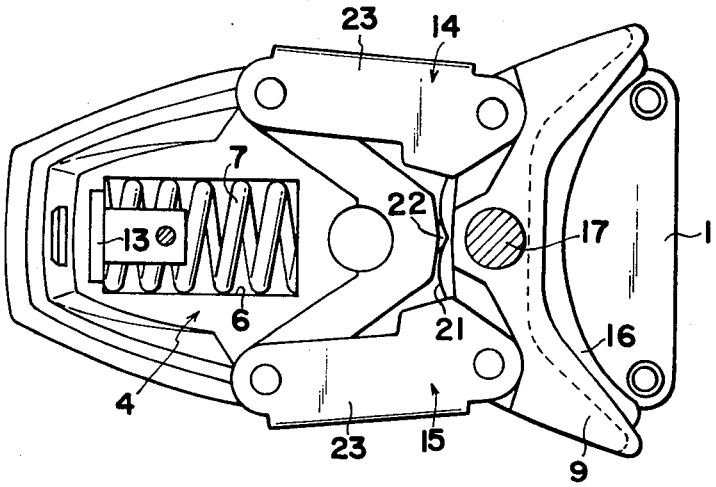
FIG. 3 is a horizontal sectional view taken along the plane of line III — III of FIG. 2 and looking in the direction of the arrows.

Referring now to a preferred embodiment of the present invention shown in FIGS. 1 to 6, the present toe binding is attached onto a ski by a base plate 1 provided with mounting holes (not shown) through which screws penetrate. The base plate 1 has a pin 2 secured on the front center part thereof received within a sleeve 3.

A pivot housing or body 4 is pivotably mounted on the base plate 1 by a pin 5 passing through registered holes at the rear center part of the body 4 and the middle center part of the base plate 1. The pivot body 4 has an axial bore 6 in which a compression spring 7 is provided to urge a pusher member 8 toward a toe holding member 9, which shall be described in detail hereinafter. The degree of compression of the spring 7 is adjusted by a flanged screw 10 extending partially into the bore 6 through the forward end wall of the body 4 and threadedly engaged with an angled indicator plate 11, the upper end of which bares outside of the bindings through an upper cover plate 12 thereof. The flange 13 of the screw 10 abuts against the inner surface of the forward end wall of the pivot body and, therefore, the rotation of the screw 10 advances or retracts the indicator plate 11 to compress or decompress the spring 7, so that the skier using this binding can know the degree of compression of the spring 7 by viewing the top of the binding.

The toe holding member 9 is swingably connected to the pivot body 4 by a pair of arm members 14 and 15 and has an arc-shaped end surface for snugly receiving the boot toe therein. Mounted on the outer end of the toe holding member is an arc-shaped toe engaging piece 16, the vertical position of which is adjusted by a screw 17 rotatably supported by the upper and lower sections of the toe holding member 9 and threadedly engaged with the piece 16. Provided around the screw 17 below the engaging piece 16 is a small compression spring 18. By rotating the screw 17, the toe engaging piece 16 can be moved up or down and placed upon the upper end of the boot sole to be fitted to this binding.

The toe holding member 9 has a cam surface 19 integrally formed on the forward or inner end thereof, which surface is provided with a concave center part 20 and a pair of arcuate projections 21 extending outwardly therefrom at both sides thereof. The pusher member 8 urged toward the toe holding member by the compression spring 7 has a roller 22 at the tip thereof, which roller 22 is usually pressed against the concave center part 20 of the cam surface and sets the toe holding member 9 in the toe holding central position thereof. The arc-shape projections 21 on the toe holding member 9 are formed in such a manner that the toe holding member 9 can automatically return to the toe holding central position thereof by the action of the compression spring 7 and the roller 22 upon removal of a lateral force applied to the toe holding member sufficient to swing the toe holding member to a displaced position but not sufficient to cause rotation of the pivot body 4, which rotation of the pivot body shall be described hereinafter.

The arm members 14 and 15 provided at both sides of the pivot body 4, each comprises upper and lower horizontal plate sections 23 and 24 and a vertical plate section 25, these sections being formed integrally from a metal piece. The toe holding member 9 is swingably connected to the pivot body 4 by a pair of pivot pins 26 and 27 which, respectively, extend through registered holes at the front ends of the horizontal plate sections 23 and 24 of the arm members, 14 and 15 and the pivot body 4, and other registered holes at the rear ends of the horizontal plate sections and the toe holding member 9. The upper horizontal plate sections 23 of the arm members 14 and 15 can slide along the cut-out portions of the pivot body 4 until they contact shoulder portions 28 thereof. The horizontal lower sections 24 of the arms each has an inwardly extending hook 29 or 30, the function of which shall be described hereinafter.

The lower portion of the pivot body 4 has a cavity in which a cam plate 31 is confined to be slidable in lengthwise direction of the base plate 1. The cam plate 31 comprises, as shown in FIGS. 1 and 4 to 6, an enlarged head portion 32 in which a substantially T-shaped trifurcated slot 33 is formed, a neck portion 34 and bifurcated arms 35. The T-shaped slot 33 is formed of an axially or longitudinally extending slotted portion 36, an arcuate lateral slotted portion 37 and a cut-out corner part 38 communicating both of the slotted parts 36 and 37 with each other. The neck portion 34 is defined by a pair of opposite recesses 39 and 40. The bifurcated arms 35 are slidably fitted at the inner edges thereof to an annular groove formed around the pin 5 pivotably connecting the pivot body 4 to the base plate 1.

The pivot body 4 has a tubular pin 41 secured thereto and extending into the cavity from the bottom thereof and loosely and slidably fitted into the axially extending slot part 36 of the cam plate 31. The hollow pin 41 contains therein a small compression spring 42 and a ball 43 pressed by the spring 42 upon an elongated groove 44 on the base plate 1.

Normally, in the toe holding position of the binding, the sleeve 3 around the pin 2 fixed on the base plate is snugly fitted to the cut-out corner part 38 of the cam plate, and the pin 5 pivotably connecting the pivot body 4 to the base plate 2 is fitted to a space between the bifurcated arms 35. Also, the inwardly extending hooks 29, 30 of the connecting arm members 15 and 16 are positioned adjacent to the shoulder portions 45 and 46 between the neck portions 34 and the arms 35 of the cam plate and are, thereby, held in an inoperative position spaced from the head portion 32 of the cam plate 31.

Figure 4:
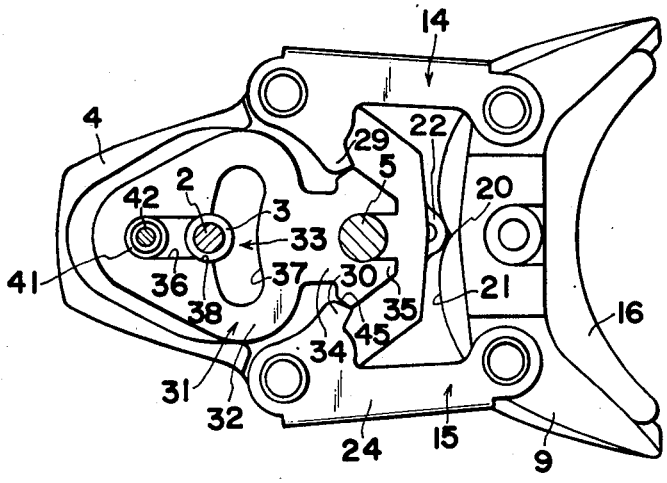
FIG. 4 is a horizontal sectional view taken along the plane of line IV — IV of FIG. 2 and looking in the direction of the arrows.
Figure 5:
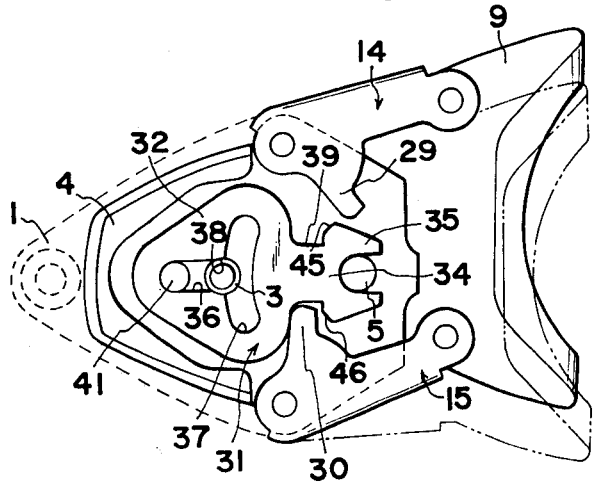
FIG. 5 is a plan view showing relative positions of a slidable cam plate and a partially displaced toe holding member of the present toe binding shown in FIGS. 1 to 4.
Figure 6:
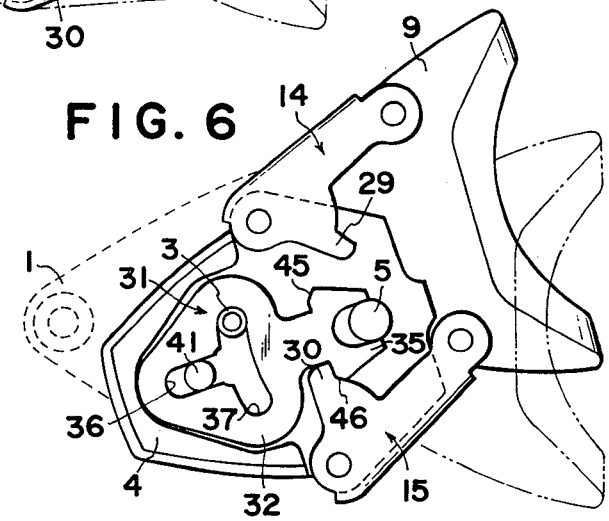
FIG. 6 is a plan view similar to FIG. 5 but showing the toe binding in the toe releasing position.

With such a structure of the present toe binding, when a severe lateral shock or force is applied to the boot toe, for example, by falling of the skier, the present binding in the toe holding central position shown in FIGS. 1 to 4 begins to be displaced toward the toe releasing position shown in FIG. 6. Namely, when the lateral force applied to the boot toe is so severe as to normally cause the skier's leg to break, the toe holding member 9 starts to swing, for example, in a counter clockwise direction from its position as shown in FIG. 4 as the arcuate projection 21 pushes back the pusher member 8 against the compression force of the spring 7 through the roller 22. At the time when the toe holding member 9 starts to swing, the hook 30 on the lower horizontal section 24 of the arm member 15 starts to enter into the recess 40 of the cam plate 31 adjacent to the neck portion thereof while the other hook 29 of the arm member 14 moves rearwardly away from the shoulder portion 45 of the cam plate. By further swinging movement of the toe holding member 9, the hook 30 of the arm member 15 comes into contact with the rear end of the head portion 32 of the cam plate 31 as shown in FIG. 5 and then pushes the cam plate forwardly. By the forward advancement of the cam plate 31, the sleeve 3 around the pin 2 secured on the base plate 1 enters into the junction of the T-shaped slots 36 and 37. Accordingly, due to the counter clockwise force applied to the pivot body 4 through the toe holding member 9 and the arm members 14 and 15, the pivot body 4 and the cam plate 31 in the cavity of the pivot body 4 rotate in a counterclockwise direction about the pivot pin 5 until the sleeve 3 abuts the end of the lateral arcuate slot 37 as shown in FIG. 6, thereby releasing the toe from the binding in this toe releasing position.

Likewise, when the same severe lateral force is applied to the boot toe in the opposite direction, the toe holding member 9 swings in a clockwise direction, which is opposite to that shown in FIG. 5, and causes the advancement of the cam plate forwardly as the other hook 29 pushes the cam plate 31 forwardly.

As may be understood from the description set forth above, when the lateral shock or force applied to the boot toe is not so severe or strong as normally to cause breakage of skier's leg, the toe holding member 9 cannot be swung or displaced against the compression force of the spring 7 to such an extent that the hook 29 or 30 pushes the cam plate forwardly to cause the sleeve 3 to enter into the lateral slot. Therefore, the sleeve 3 about the pin 2 secured on the base plate 1 remains in the cut-out corner part 38 of the slots in the cam plates, thereby maintaining the pivot body 4 stationary in the locking position. Immediately after the less severe force applied to the boot toe is released, the toe holding member returns to the normal toe holding position as the roller 22 slides back by the spring force to the concave center part 20 along the arcuate projection 21, thereby absorbing the lower force applied to the boot.

The toe binding displaced to the boot toe releasing position can easily be reset to the toe holding central position by manually pressing only the displaced pivot body to the central position. That is, since the arcuate projections 21 on the inner surface of the toe holding member 9 are so formed that the toe holding member can automatically return to the toe holding central position by the action of the spring 7 from the displaced position thereof, and also since the hook 29 or 30 on the arm member 14 or 15 is so formed that the hook can pull back the cam plate 31 by engaging with the shoulder portion 45 or 46 thereof while the toe holding member returns to the toe holding position, in the event that the pivot body 4 is manually pressed to the central position, the toe holding member 9 automatically swings back in the toe holding central position by pulling the cam plate 31 and, therefore, the sleeve 3 enters into the corner portions 38 in the T-shaped slot 33 to set the pivot body in the locking position, whereby the binding is not displaced until a severe lateral shock is applied again to the toe holding member as described herein. The manual resetting operation of the pivot body can be accomplished very easily by applying only a small force to the pivot body by the skier's fingers, since no spring force is being applied to the pivot body in the toe releasing position.

Figure 7:
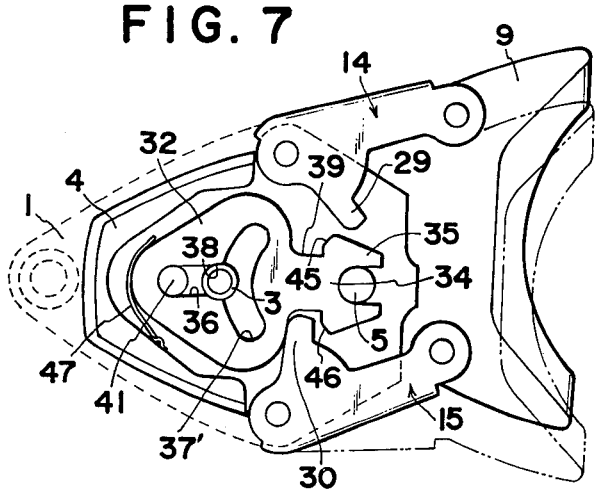
FIG. 7 is a plan view similar to FIG. 5 but showing another embodiment of the present invention.

In the embodiment set forth above, the lateral slot 37 in the cam plate 31 is formed in an arc-shape with a radius of curvature from the pin 5 to allow the pivot body 4 and the cam plate to smoothly rotate about the pin 5. However, in order to facilitate the automatic return of the pivot body to the central position from the toe releasing position shown in FIG. 6, a modification may be made in the present binding as shown in FIG. 7. In this modified embodiment, the lateral slot 37' in the cam plate 31 is formed so as to have a radius of curvature smaller than that formed about the pin 5 as it is in the first embodiment. With such a structure of the modified embodiment, the cam plate in the toe releasing position is pulled with a relatively strong froce by the hook of the arm member engaging with the shoulder of the cam plate against the sleeve 3 on the base plate, so that the pivot body is automatically returned to the toe holding central position from the toe releasing position thereof. Further, to achieve the automatic return of the pivot body more effectively, a leaf spring 47 may be provided in the cavity of the pivot body 4 and secured at one end thereof to the wall of the cavity to urge the cam plate 31 rearwardly toward the pin 5.

Although the present invention has been described with reference to the preferred embodiments thereof, many modifications and alterations may be made within the spirit of the present invention.

I claim:

1. A ski boot toe binding comprising a base plate adapted to be attached on a ski, a pivot body, a pin extending upwardly from said base plate and through said pivot body thereby pivotably mounting said pivot body on said base plate, a toe holding member swingably mounted on said pivot body for receiving a boot toe, a pair of arms, one at each side of said plate, each pivotably connected at one end thereof to said pivot body and at the other end thereof to said toe holding member, an opening in said pivot body, yieldable means provided in said opening and acting upon said toe holding member to urge the latter to a toe holding center position, a cam plate provided between said base plate and said pivot body and movable from a locking position to an unlocking position, means mounting said cam plate for sliding movement with respect to said base plate and pivot body and for rotating movement about said pin, cooperating interengageable means on said cam plate and said arms normally disengaged with respect to both arms while said toe holding member is in the boot toe holding central position, said toe holding member and one of said arms being adapted to be swung upon the application of a first predetermined force, from the central position thereof through a predetermined stroke to a locking position of the toe holding member where said interengageable means is engaged with respect to one of said arms, and said pivot body is immovably engaged with said base plate, and said cam plate being slidably moved in the lengthwise direction of said base plate by said one arm after said toe holding member is swung beyond said predetermined stroke by the application of a force greater than said first force and assuming a rotated unlocking position where the engagement between said pivot body and said base plate is released, thereby allowing said pivot body to rotate about said pin on said base plate and release said toe holding member from the ski boot toe.

2. A ski boot toe binding as claimed in claim 1, wherein said cam plate is provided with a longitudinal slot and a lateral slot communicating with each other to form a trifurcated slot; said base plate has a projection thereon received within an end of said longitudinal slot adjacent to said lateral slot while said cam plate is in the locking position thereof; and said pivot body has a projection slidably received in the other end portion of said longitudinal slot in said cam plate, said projection on said base plate entering into said lateral slot when said cam plate is slidably moved by said arm and allowing said pivot body to rotate about said pin until said projection on said base plate abuts against the end of said lateral slot.

3. A ski boot binding as claimed in claim 1, wherein said toe holding member has a pair of oppositely extending arcuate projections on the inner surface thereof providing a concave portion therebetween; and a roller is pressed by said yieldable means against said concave portion to set said toe holding member to the toe holding central position, each of said arcuate projections being adapted automatically to return said toe holding member to the toe holding central position thereof by the combined action of said yieldable means and said roller upon removal of a lateral force against said toe holding member which was not sufficient to swing said toe holding member beyond said predetermined stroke.

4. A ski boot toe binding as claimed in claim 2, wherein said cam plate has a head portion, within which said trifurcated slot is formed, a neck portion, and shoulder portions; said interengaging means includes said neck and shoulder portions and an inwardly projecting hook portion on the rear end of said arm positioned adjacent to said shoulder portion of said cam plate when said toe holding member is in the toe holding central position thereof; said hook portion being freely movable to a position adjacent to said neck portion when said toe holding member is swung, thereby to push against an end of said head portion when said toe holding member is swung a sufficient distance beyond said predetermined stroke, said hook portion also being adapted to engage with said shoulder portion thereof while said toe holding member returns to the normal boot toe holding position from a toe releasing position, thereby to return said cam plate to the normal position thereof.

5. A ski boot toe binding as claimed in claim 2, wherein said projection mounted on said base plate has a sleeve thereon which is rotatable when it slides along the slots.

6. A ski boot toe binding as claimed in claim 2, wherein said cam plate is held in a forward position by a spring having a relatively weak force.

7. A ski boot toe binding as claimed in claim 2, wherein said lateral slot in said cam plate has a radius of curvature smaller than that formed from said pin pivotably connecting said pivot body to said base plate.

* * * * *